US009803815B2

(12) United States Patent
Cousin

(10) Patent No.: US 9,803,815 B2
(45) Date of Patent: Oct. 31, 2017

(54) ILLUMINATED TILE FOR A FALSE WALL AND FALSE WALL INCORPORATING SUCH A TILE

(71) Applicant: NEWMAT, Haubourdin (FR)

(72) Inventor: Etienne Cousin, Haubourdin (FR)

(73) Assignee: NEWMAT, Haubourdin (FR)

( * ) Notice: Subject to any disclaimer, the term of this patent is extended or adjusted under 35 U.S.C. 154(b) by 89 days.

(21) Appl. No.: 14/442,305

(22) PCT Filed: Nov. 20, 2013

(86) PCT No.: PCT/FR2013/052799
§ 371 (c)(1),
(2) Date: May 12, 2015

(87) PCT Pub. No.: WO2014/080123
PCT Pub. Date: May 30, 2014

(65) Prior Publication Data

US 2016/0281941 A1 Sep. 29, 2016

(30) Foreign Application Priority Data

Nov. 20, 2012 (FR) ..... 12 61032

(51) Int. Cl.

| | |
|---|---|
| ***F21S 8/04*** | (2006.01) |
| ***E04B 9/04*** | (2006.01) |
| ***E04B 9/32*** | (2006.01) |
| ***E04B 9/00*** | (2006.01) |
| ***E04B 9/06*** | (2006.01) |
| ***E04B 9/24*** | (2006.01) |
| ***F21V 1/16*** | (2006.01) |

(Continued)

(52) U.S. Cl.
CPC ..... *F21S 8/043* (2013.01); *E04B 9/006* (2013.01); *E04B 9/0478* (2013.01); *E04B 9/064* (2013.01); *E04B 9/24* (2013.01); *E04B 9/32* (2013.01); *F21S 8/04* (2013.01); *F21S 8/046* (2013.01); *F21V 1/16* (2013.01); *F21V 19/0015* (2013.01); *E04B 2009/0492* (2013.01); *F21Y 2101/00* (2013.01); *F21Y 2103/10* (2016.08); *F21Y 2105/10* (2016.08); *F21Y 2115/10* (2016.08)

(58) Field of Classification Search
CPC .. F21S 8/043; F21S 8/046; F21V 1/16; F21V 19/0015; F21Y 2105/003; E04B 9/0478
USPC ..... 362/147, 148, 150
See application file for complete search history.

(56) References Cited

U.S. PATENT DOCUMENTS

| | | | | |
|---|---|---|---|---|
| 2007/0157535 | A1 | 7/2007 | Cousin | |
| 2009/0073673 | A1* | 3/2009 | Young | G09F 13/14 362/97.1 |
| 2012/0140446 | A1* | 6/2012 | Seetzen | G02F 1/133605 362/97.1 |

FOREIGN PATENT DOCUMENTS

| | | | |
|---|---|---|---|
| DE | 199 43 478 | A1 | 4/2001 |
| EP | 1 783 292 | A1 | 5/2007 |
| EP | 2 472 174 | A1 | 7/2012 |

OTHER PUBLICATIONS

International Search Report for PCT/FR2013/052799 dated May 8, 2014.

* cited by examiner

*Primary Examiner* — Laura Tso
(74) *Attorney, Agent, or Firm* — Sughrue Mion, PLLC

(57) ABSTRACT

A lighted tile for false panel, including a frame having a bottom and sides that extend projecting from the bottom, a (Continued)

backlighting system having a series of lights attached to the bottom, and a stretched flexible sheet that extends between the sides facing the lights. The lights are light-emitting diodes, and the sheet is secured to the sides of the frame.

7 Claims, 5 Drawing Sheets

(51) Int. Cl.

| | |
|---|---|
| ***F21V 19/00*** | (2006.01) |
| *F21Y 103/10* | (2016.01) |
| *F21Y 115/10* | (2016.01) |
| *F21Y 101/00* | (2016.01) |
| *F21Y 105/10* | (2016.01) |

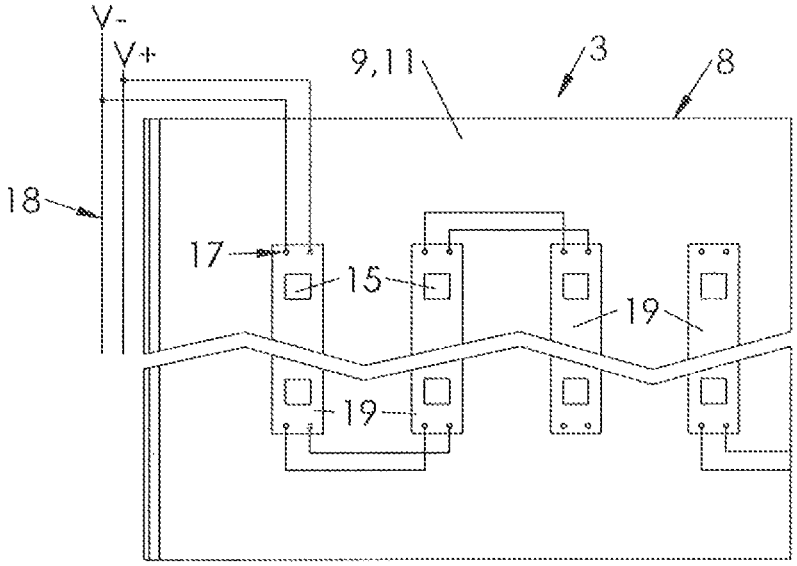
FIG.6
FIG.7
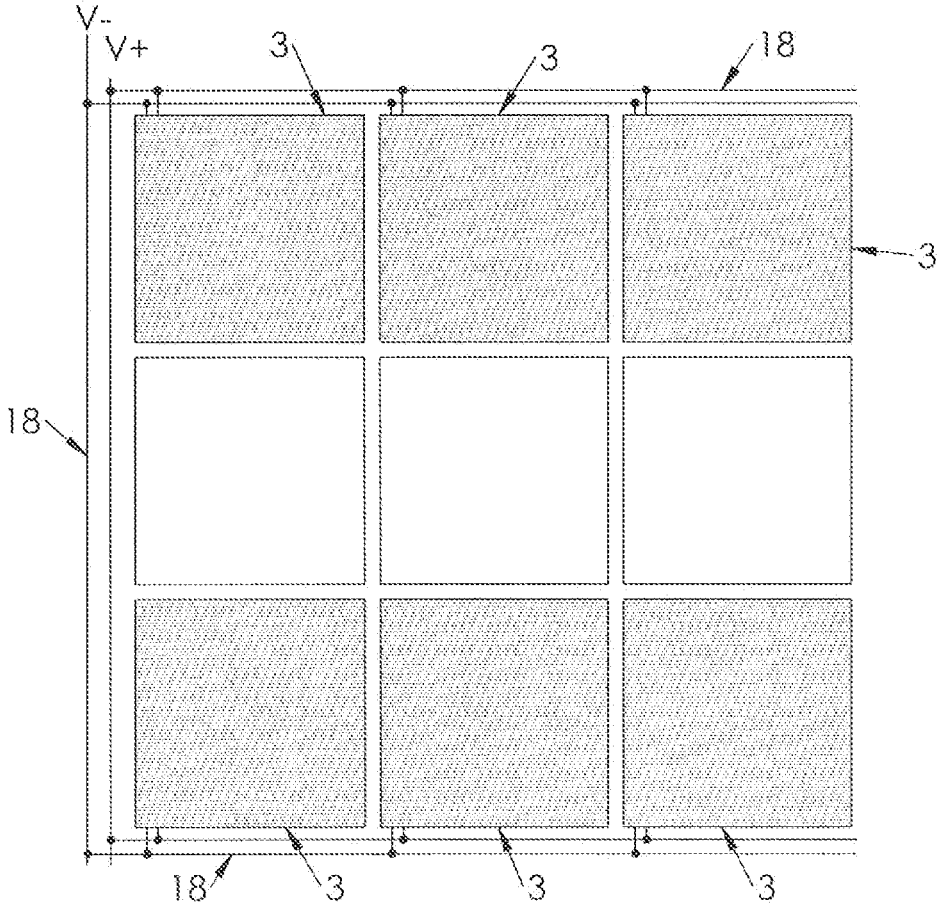

ILLUMINATED TILE FOR A FALSE WALL AND FALSE WALL INCORPORATING SUCH A TILE

CROSS REFERENCE TO RELATED APPLICATIONS

This application is a National Stage of International Application No. PCT/FR2013/052799 filed Nov. 20, 2013, claiming priority based on French Patent Application No. 1261032 filed Nov. 20, 2012, the contents of all of which are incorporated herein by reference in their entirety.

The invention relates to the technical domain of false panels, such as false ceilings and false walls.

More particularly, the invention relates to false panels comprising a fabric (particularly of PVC) stretched between profiles attached to a wall or a ceiling.

The integration of lighting in such a panel is problematic.

A common technique consists of cutting openings into the fabric to allow passage of lights such as spots provided with halogen bulbs. However, this technique is not without its disadvantages: said cuts can cause incipient breaks in the fabric that can propagate, and areas through which air, dust or insects can enter the space behind the false panel.

Another known technique consists of backlighting the sheet, by mounting lights directly on the subjacent panel (wall or ceiling) so that the light is diffused by the sheet. This technique is also not without its disadvantages: defective lights can only be replaced by removing the sheet.

Moreover, tiles are known that make it possible to produce false panels modularly by juxtaposition of tiles. Use of this type of tile to achieve lighting is known. The document EP 2 472 174 proposes a box comprising a frame having a bottom and sides that extend projecting from the bottom, a series of fluorescent tubes attached to the bottom, and a flexible sheet extended over a frame articulated with respect to the frame by means of a sliding pivot connection. Said articulation is to facilitate access to the inside of the box for purposes of maintenance operations (for example, replacement of a defective fluorescent tube).

The technique described in the document EP 2 472 174 is also not without its disadvantages.

Firstly, the structure of the box is relatively complex.

Secondly, maintenance operations are rather tedious, particularly when they must be carried out on a false ceiling, from a stepladder with one's arms extended.

Thirdly, the box must be sufficiently rigid (and therefore rather heavy) in order to absorb the stresses it undergoes during replacement of a light.

Fourthly, the box is relatively deep, particularly due to the volume occupied by the lights, by the articulation and by the frame, relatively thick, and also due to the significant distance between the stretched sheet and the fluorescent tubes, which is necessary to ensure a certain diffusion of the light. The result is that this type of box can only be used when there is a great deal of space beneath the ceiling. Otherwise, the remaining height beneath the false ceiling would be less than the standardized minimum height.

A first objective is to propose a light box having increased lightness.

A second objective is to propose a light box offering good qualities of diffusion of the light.

A third objective is to propose a light box requiring little (or no) maintenance.

A fourth objective is to propose a light box for which the electrical connection is easy.

To that end, first, a lighted tile for false panel is proposed, comprising a frame having a bottom and sides that extend projecting from the bottom, a backlighting system comprising a series of lights attached to the bottom, and a stretched flexible sheet that extends between the sides facing the lights, wherein the lights are light-emitting diodes, and the sheet is secured to the sides of the frame.

Proposed, in the second place, is a false panel comprising a set of tiles like the tile presented above.

Various additional characteristics can be provided, alone or in combination:

- The diodes are integrated into a mat secured to the bottom.
- The diodes are integrated into one or more strips secured to the bottom.
- The sheet is formed by a flexible shell enclosing the frame and stretched over it.
- The frame is openwork.
- The sheet is perforated.
- The false panel is a false ceiling, and the tiles rest on lower flanges of beams secured to a subjacent ceiling.

Other objects and advantages of the invention will be seen from the description of one embodiment, provided below with reference to the appended drawings in which:

FIG. 6 is a view similar to FIG. 5, illustrating the series electrical wiring of the strips of diodes.

FIG. 7 is a view showing a false panel integrating light boxes and illustrating the parallel electrical connection of the boxes.

Figure 1:
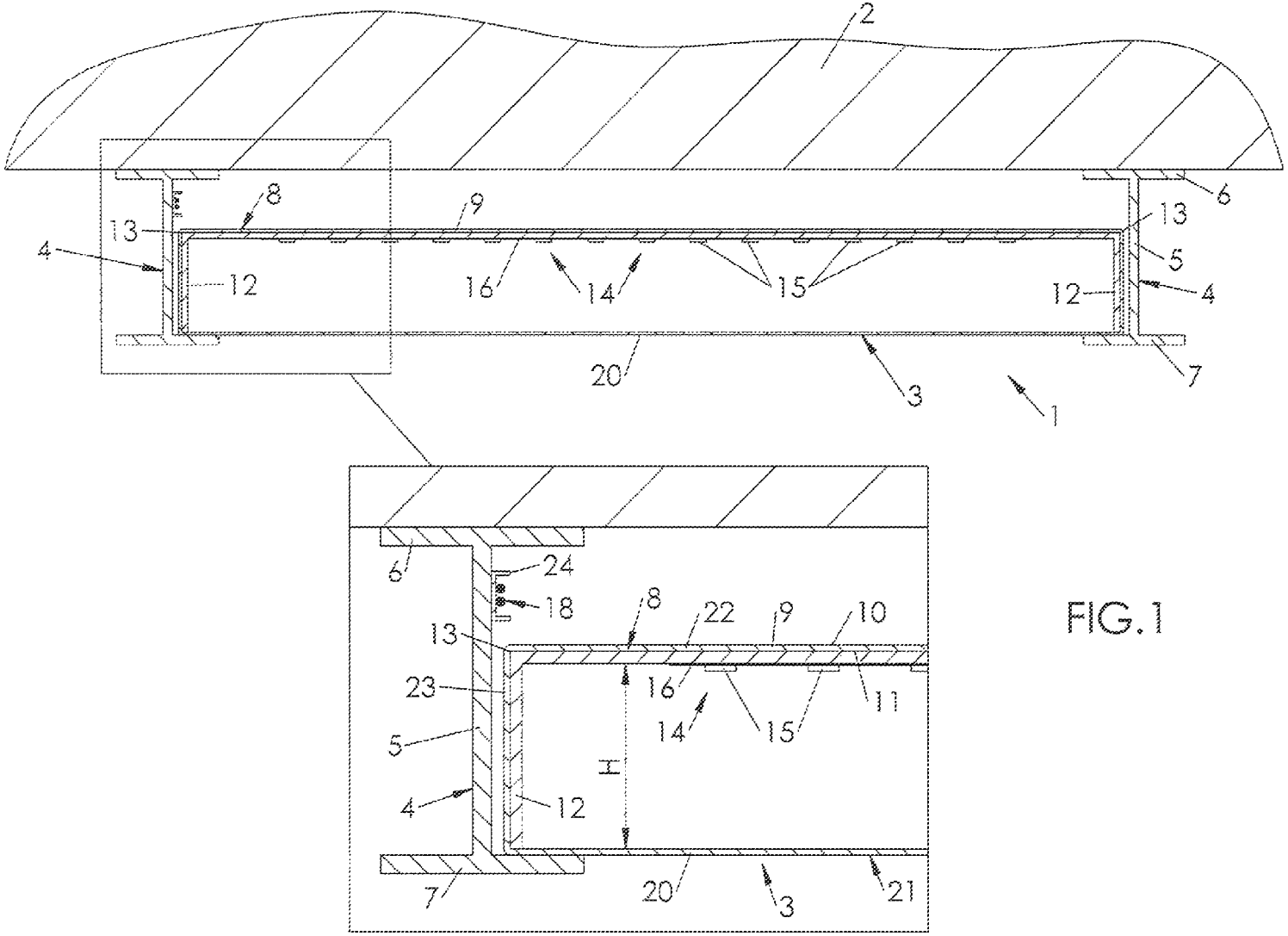
FIG. 1 is a view in cross-section showing a light box equipping a false ceiling, with a detailed inset in larger scale.

Represented in FIG. 1 is a false panel 1. In this instance, it involves a false ceiling, but it could involve a false wall.

As can be seen in the figure, the false panel 1 is mounted on a rigid subjacent panel 2 (in this instance, a ceiling), for example of concrete.

The false panel 1 is formed by a juxtaposition of a plurality of tiles, including at least one lighted tile 3. The lighted tile 3 is suspended by means of beams attached to the panel 2. More specifically, each beam 4 is an I-beam comprising a vertical central web 5, and at the ends of the web 5, an upper flange 6 by which the beam 4 is attached to the panel 2, and an opposite lower flange 7.

As can be seen in FIG. 1, the tile 3 is suspended between two successive beams by resting jointly on the lower flanges of the two beams 4.

The tile 3 comprises a frame 8 made of a plastic material such as PVC, or preferably of sheet metal, for example aluminum or aluminum alloy.

The frame 8 comprises a substantially flat bottom 9 having an outer face 10 turned towards the panel 2, and an opposite inner face, as well as sides 12 that extend projecting from the inner face 11.

As can be seen in FIG. 1, the sides 12 extend along the edges 13 of the bottom. According to one particular embodiment, the frame 8 comprises only two sides 12, which extend along opposite parallel edges 13 of the bottom 9.

As a variant, the frame 8 comprises four sides 12 that are parallel two by two, forming a belt that encloses the bottom 9.

The tile 3 is further equipped with a backlighting system 14, which comprises a series of lights 15 attached to the bottom 9. The lights 15 are light-emitting diodes, which have the advantage of having a long working life compared to conventional lights (particularly incandescent or gas, typically halogen or neon).

The diodes 15 are preferably white, but can also be colored. According to one particular embodiment, the diodes 15 are monochromatic. As a variant, the diodes can be trichromatic, and a remote unit can be provided to control the color of the diodes 15, comprising for example a variator for each basic color (typically red, green, blue). Said unit can be programmable, and can include programs for varying the color and/or luminosity of the diodes.

Figure 2:
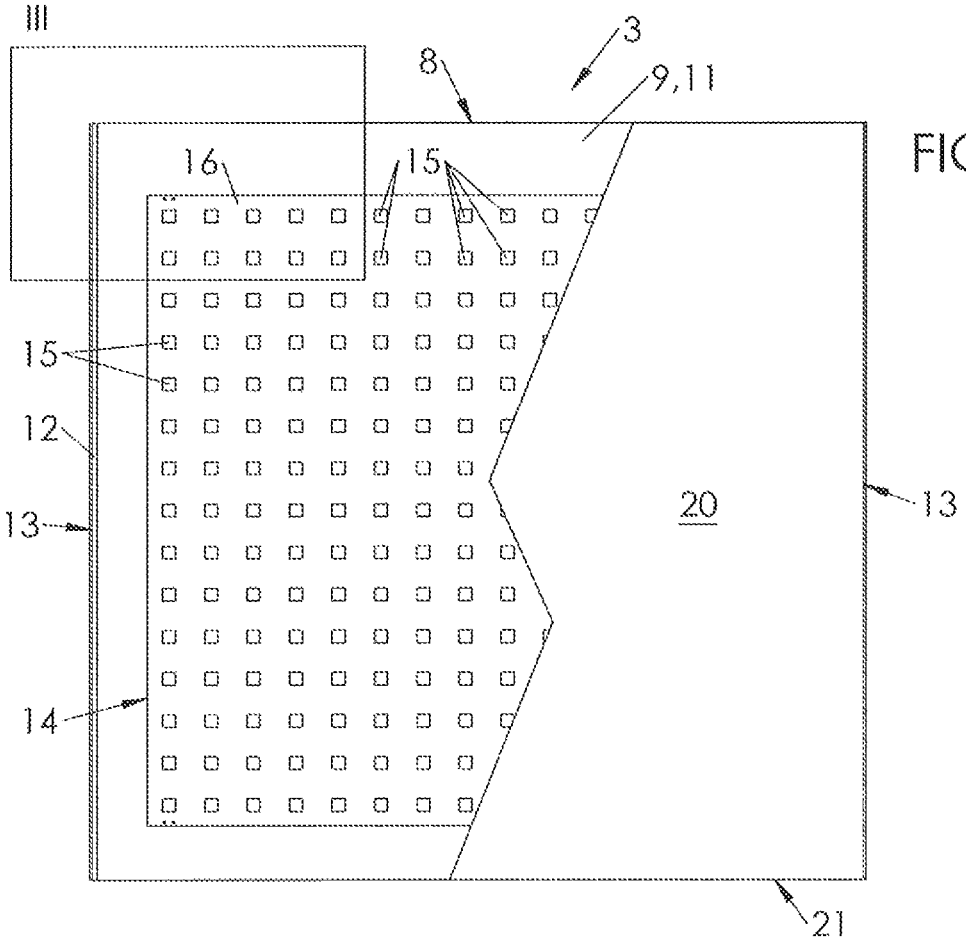
FIG. 2 is a front view, in partial cutaway, showing a light box equipped with a sheet of light-emitting diodes.

According to a preferred embodiment illustrated in FIG. 2, the diodes are incorporated into a mat 16. The diodes 15 are organized in a matrix on said mat 16, i.e., according to a regular pattern of lines and columns of juxtaposed diodes 15. The separation between two neighboring diodes can vary, depending in particular on the individual power of the diodes 15.

Within said mat 16, the diodes are wired to all be supplied with direct current. The wiring can be in series or parallel. The two can be combined: the diodes of one line can be wired in series, and the lines themselves wired in parallel. Parallel wiring makes it possible to maintain a supply of current (and thus illumination of the diodes 15) in the event of failure of one or more diodes within the mat 16.

Figure 3:
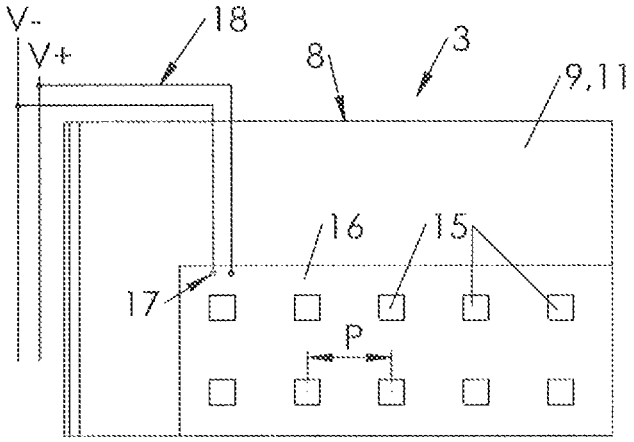
FIG. 3 is a view in detail, in larger scale, of the box of FIG. 2, according to the inset III and illustrating the wiring of the sheet.

To that end, the mat 16 comprises electrical terminals 17 that, as illustrated in FIG. 3, are positioned in the vicinity of one edge of the mat 16, and which are electrically connected to an external electrical circuit 18 supplying direct current. Said direct current can itself be received from an AC/DC-type transformer, producing low-voltage (typically 12 V) direct current from a single-phase alternating current received from the mains (typically 220 V).

Figure 4:
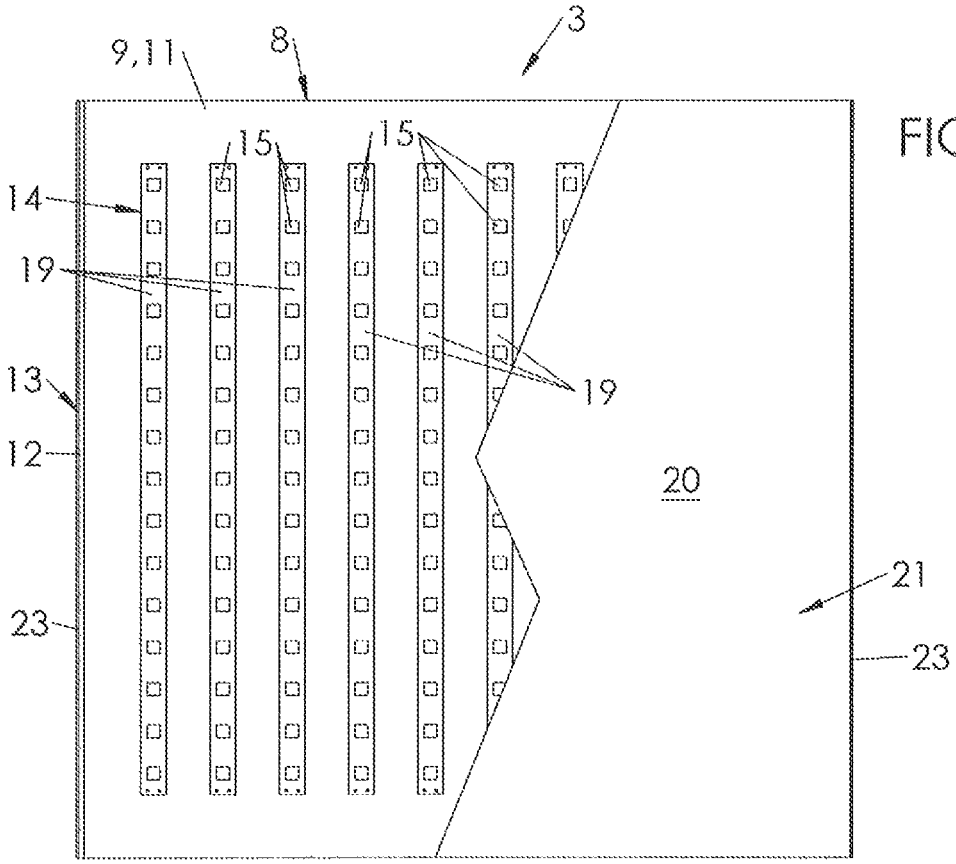
FIG. 4 is a view similar to FIG. 2, showing a light box equipped, as a variant, with a series of strips of light-emitting diodes.

According to an alternate embodiment illustrated in FIG. 4, the diodes are incorporated into juxtaposed strips 19 to form rows (lines or columns), producing a result similar to the mat 16 described above. Within the strips 19, the diodes are wired in series or in parallel, the strips 19 being provided with terminals 17 for connection to the external electrical circuit 18.

Figure 5:
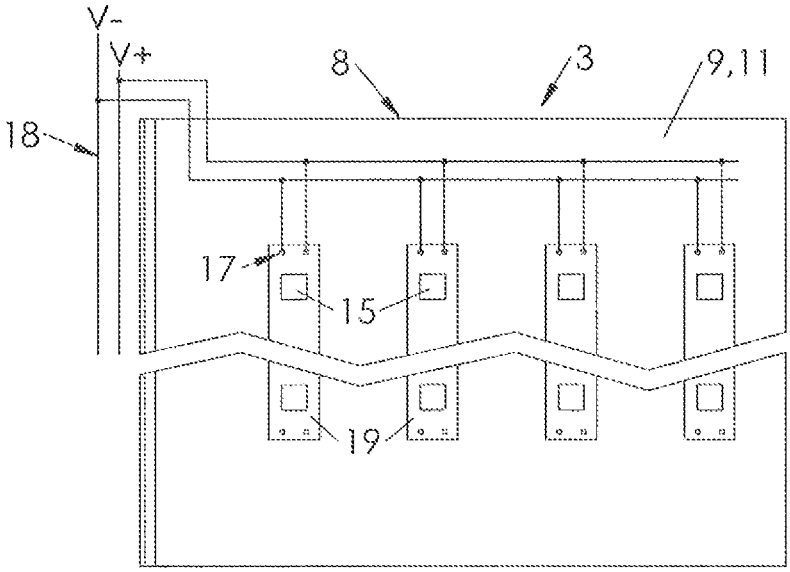
FIG. 5 is a view in detail, in larger scale, of the box of FIG. 2, illustrating the parallel electrical wiring of the strips of diodes.

As illustrated in FIG. 5, the strips 19 can be wired in parallel, while all of them are directly connected to the external electrical circuit 18. As a variant, however, as illustrated in FIG. 6, the strips 19 can be wired in series, a first strip (for example, situated along one edge 13 of the bottom 9) being connected to the circuit 18 and the subsequent strips 19 being wired in series from the first one.

The tile further comprises a stretched flexible sheet 20 that extends between the sides 12 of the frame 8, in front of the diodes 15. More specifically, the sheet 20 extends to the sides 12 to which it is secured. Thus, the sheet 20 covers all of the internal volume of the frame 8, i.e., the volume over the diodes and defined by the bottom 9 and the sides 12.

According to one embodiment, the sheet 20 could be fastened to the sides 12, for example by means of a rail integral with the sides 12 (for example, formed directly during manufacturing of the frame 8), or appended and attached thereto, for example by screwing, gluing or welding.

However, according to one embodiment illustrated in FIG. 1, the sheet 20 is formed by a flexible shell 21 enclosing the frame 8 and stretched over it. More specifically, as can be seen in FIG. 1, the shell 21 is closed and has four sections, namely a front section forming the sheet 20, a rear section 22 covering the bottom 9 over the outer face 10 thereof, connected by lateral sections 23 covering the sides 12 of the frame 8.

The sheet 20 (that is, the shell 21 in the embodiment just described) is for example produced from a polymer fabric (such as PVC). In one embodiment, the sheet 20' can be perforated with openings 31 as shown in FIG. 8, to allow the evacuation of the heat released by the lights 15 when operating and/or for purposes of acoustic attenuation.

Figure 8:
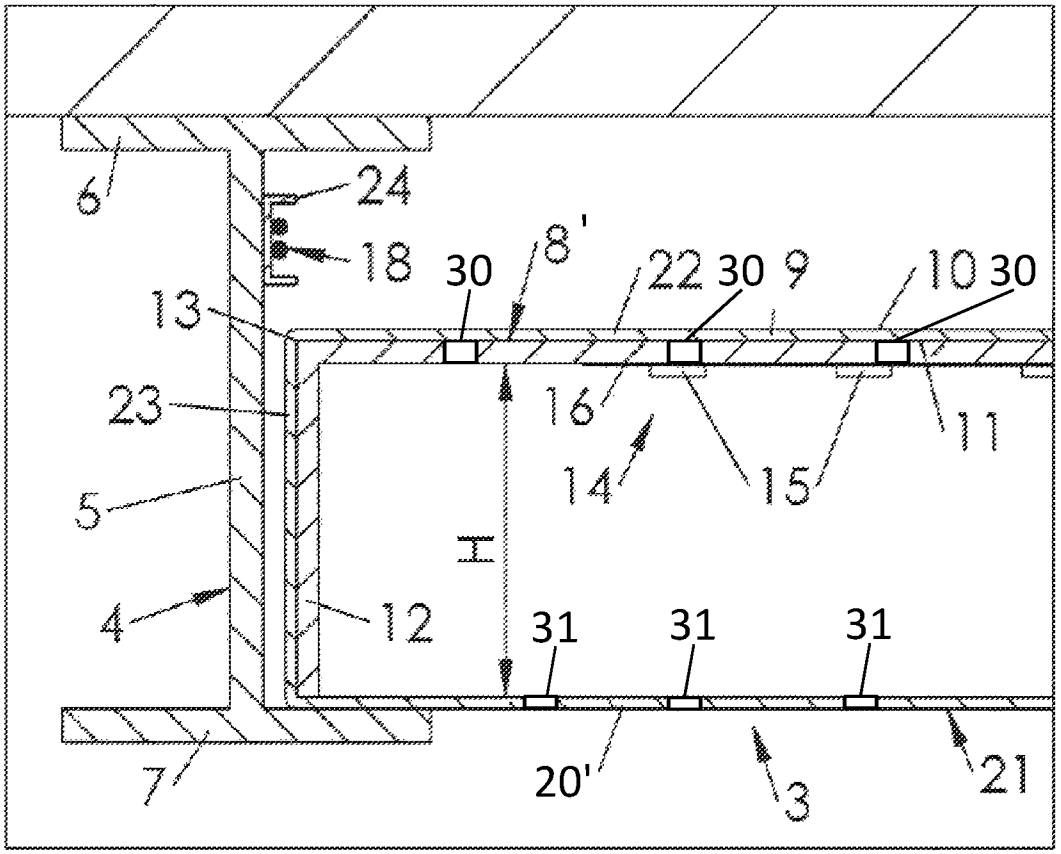
FIG. 8 is a view similar to the inset of FIG. 1 showing an alternative embodiment of the mat and the flexible sheet.

In one embodiment, the frame 8' (on the bottom 9 and/or on the sides 12) can be of openwork with openings 30 as shown in FIG. 8, for purposes of lightness and also evacuation of the heat released by the lights 15 when operating.

Represented in FIG. 7 is an example of arrangement of tiles comprising unlighted (white) tiles and lighted (gray) tiles. The lighted tiles can be connected to the electrical circuit 18 by being wired in series, but for better security, it is preferable, as illustrated, to connect them in parallel so that any failure of one of the lighted tiles 3 is not propagated to the neighboring lighted tiles.

In this way, it is possible to provide the total or partial illumination of a panel. The tiles can also be arranged according to predefined patterns. Lighted tiles of different colors can also be provided. To that end, the diodes will be selected according to the wishes of the recipient. Similarly, programmed illuminations can be considered that are propagated over all of the lighted tiles, by means of a properly programmed remote control unit.

In operation, the illumination of the diodes produces a non-uniform light in the vicinity of said diodes, comprising peaks of intensity in front of each diode 15 (the intensity of the peaks varies depending on the aperture angle of the light cone produced by each diode 15). The sheet 20 plays the role of a diffuser, smoothing the intensity peaks in order to transmit a relatively diffuse luminous flux from the point of view of the human eye. A function of the sides 12 is to maintain a separation (denoted H and corresponding to the height of the sides, measured from the bottom 9, assuming the added thickness formed by the diodes 15 to be negligible) between the diodes and the sheet 20. If the separation H is small, the light transmitted by the sheet 20 is of relatively strong intensity, but comprises visible peaks due to the proximity of the diodes 15. On the contrary, if the separation H is relatively large, the light transmitted by the sheet 20 is of relatively low intensity, but it appears diffuse and relatively free of peaks, due to the distance of the diodes 15. It is therefore preferable to find a compromise for the separation H, based on the power of the diodes 15, the density of their distribution over the bottom 9 and the thickness of the sheet 20.

Typically, for white-light diodes of individual power of about 0.2 W, an aperture angle of the light cone produced by each diode 15 of about 120°, an interval (denoted P and corresponding to the average distance between two adjacent diodes) of about 20 mm, and a sheet 20 made of white PVC (perforated or not) a few tens of mm thick, it will be best to provide a separation H of a few centimeters (typically from 5 to 10 cm).

As can be seen in FIG. 1, the wires of the electrical supply circuit 18 can advantageously be installed in a wireway 24 attached to the web 5 of the beam 4.

The invention claimed is:

1. A lighted tile for false panel, comprising a frame having a bottom and sides that extend projecting from the bottom, a backlighting system comprising a series of lights attached to the bottom, and a stretched flexible sheet that extends between the sides facing the lights, characterized in that the lights are light-emitting diodes, and the sheet is formed by a flexible shell enclosing the frame, stretched and secured to the sides of the frame.

2. The tile according to claim 1, characterized in that the diodes are integrated into a mat secured to the bottom of the frame.

3. The tile according to claim 1, characterized in that the diodes are integrated into one or more strips secured to the bottom of the frame.

4. The tile according to claim 1, characterized in that the frame is openwork.

5. The tile according to claim 1, characterized in that the sheet is perforated.

6. A false panel, characterized in that said false panel comprises a set of tiles according to claim 1.

7. The false panel according to claim 6, characterized in that said false panel is a false ceiling, and the tiles rest on lower flanges of beams secured to a subjacent ceiling.

* * * * *